United States Patent [19]

Schoustra et al.

[11] 4,054,450

[45] Oct. 18, 1977

[54] INDIRECT ELECTROPHOTOGRAPHIC PROCESS WITH A NITRO-PHENOLSULTONEPHTHALEIN

[75] Inventors: Bauke Schoustra, Tegelen; Hubertus W. H. M. Roncken, Helden, both of Netherlands

[73] Assignee: Oce-van der Grinten N.V., Venlo, Netherlands

[21] Appl. No.: 483,566

[22] Filed: June 27, 1974

[30] Foreign Application Priority Data

| | | |
|---|---|---|
| July 9, 1973 | United Kingdom | 32553/73 |
| Nov. 15, 1973 | United Kingdom | 53088/73 |
| Nov. 15, 1973 | United Kingdom | 53089/73 |

[51] Int. Cl.[2] ..... G03G 5/09

[52] U.S. Cl. ..... 96/1 R; 96/1.6

[58] Field of Search ..... 96/1.6 R, 1.8; 252/501

[56] References Cited

U.S. PATENT DOCUMENTS

| | | | |
|---|---|---|---|
| 3,122,435 | 2/1964 | Noe et al. | 96/1.6 |
| 3,287,116 | 11/1966 | Hoegl | 96/1.5 |
| 3,498,835 | 3/1970 | Chiang et al. | 96/1.6 |
| 3,689,260 | 9/1972 | Honjo | 96/1.7 |
| 3,832,171 | 8/1974 | Janssens et al. | 96/1.6 |

*Primary Examiner*—David Klein
*Assistant Examiner*—John L. Goodrow
*Attorney, Agent, or Firm*—Albert C. Johnston

[57] ABSTRACT

Fading of the light-sensitivity of a dye-sensitized photoconductive layer used repeatedly for image formation in indirect electrophotographic copying is avoided by employing a photoconductive layer sensitized by a nitro-substituted dye such as a nitro-fluorescein or a nitrophenolsulfonephthalein.

8 Claims, No Drawings

INDIRECT ELECTROPHOTOGRAPHIC PROCESS WITH A NITRO-PHENOLSULTONEPHTHALEIN

This invention relates to a process for indirect electrophotography in which use is made of a dye sensitized photoconductive sheet material.

Various organic photoconductors and the white or nearly white inorganic photoconductors such as zinc oxide show the greatest sensitivity to radiation of a wavelength below 4200 A. It is already known that the spectral sensitivity of photoconductive materials can be extended to the complete visible spectrum by adding one or more organic dyes which are capable of absorbing radiant energy and transferring it to the photoconductor.

However, the light-sensitivity of the known dye sensitized photoconductive materials fades considerably if the photoconductive materials are subjected to the combined action of repeated charging, exposure, development and transferring in an indirect electro-photographic process.

It is believed that fading of the light-sensitivity is at least partially caused by decomposition of the dye by ozone and/or atomic oxygen which are formed during charging and exposing the photoconductive material.

According to the invention there is provided a process for indirect electrophotographic copying wherein a transferable image is produced on a photoconductive layer which is sensitized by one or more dyes represented by the following formula and mesomeric and tautomeric forms thereof:

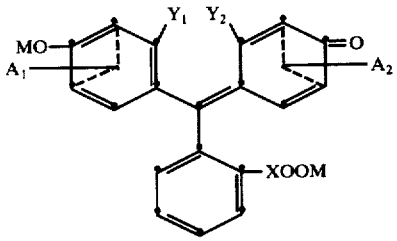

in which M represents a hydrogen or metal atom or a methyl or ethyl/group, $A_1$ or $A_2$ or both $A_1$ and $A_2$ represent a nitro group in an ortho position with respect to the —OM and/or keto group, X represents a carbon atom or a SO group and $Y_1$ and $Y_2$ each represent a substituent selected from the group consisting of hydrogen and halogen atoms and lower alkyl, lower alkoxy, nitro, hydroxyl and esterified hydroxyl groups or $Y_1$ or $Y_2$ together represent a heterocyclic oxygen, sulphur or selenium atom. The nitrosubstituted dyes used in the process according to the invention may contain additional substituents selected from the group consisting of halogen atoms and lower alkyl, lower alkoxy, nitro, hydroxyl and esterified hydroxyl groups.

The electrophotographic sheet material used in the process according to the invention is much more stable to the action of processing conditions than a similar electrophotographic sheet material sensitized with a corresponding dye containing no nitro groups. In addition, photoconductive layers containing a mixture of one or more of the nitro-substituted dyes defined above and one or more other sensitizing dyes also resist the processing conditions as far as fading of the light-sensitivity is concerned, even when the latter dyes are rather unstable. For example, the light-sensitivity of a photoconductive layer based on zinc oxide, a binder and a mixture of saffrosine (CI Index No. 45400) or nitrated Bromphenol Red with methylene blue TGO (CI Index No. 52025), erythrosine (CI Index No. 45430) or bromphenol blue does not decrease as a result of repeated charging and exposure, although the light-sensitivity of a photoconductive layer containing methylene blue, erythrosine or bromphenol blue without a nitro-substituted dye decreases considerably under the same conditions. The addition of a Lewis acid such as hydro-chloric acid as an activator to increase the light-sensitivity of the photoconductive sheet materials according to the invention does not adversely affect the stability.

The nitro-substituted dyes used in the process according to the invention may be prepared by treating commerially available dyes with a mixture of concentrated nitric acid and concentrated sulphuric acid at a temperature of about 0° C. The dyes may also be prepared by substituting nitro/groups for halogen atoms in commercially available dyes by heating a solution of a halogen substituted dye in ethanol with a 65% solution of nitric acid at a temperature of about 75° C.

The photoconductive layer may be composed of an organic photoconductor with or without a binder or an inorganic photoconductor such as finely divided zinc oxide or so-called pink zinc oxide dispersed in a binder such as a mixture of polyvinyl/acetate and a styrene-ethylacrylate copolymer. Other binders such as acrylic acid esters, methacrylic acid esters, chlorinated rubber, vinyl polymers such as polyvinyl chloride and polyvinyl acetate, cellulosic esters and ethers, alkyd resins, epoxy resins, silicone resins, photoconductive resins such as polyvinylcarbazole, and mixtures and copolymers of these products, may also be used.

The sensitizing dyes may be incorporated in the photoconductive layer in an amount of between 0.001 and 1% by weight of the photoconductor. Usually concentrations between about 0.02 and 0.25% by weight of the photoconductor are preferred in zinc oxide-binder coatings for indirect electrophotographic processes.

The photoconductive layer may be applied to any support which is common for photoconductive layers; for example, use may be made of metallic, plastic or paper supports which may be provided with an insulating or conductive layer to modify the electric properties. Said layer may be composed of metal, plastic or a conductive pigment such as carbon dispersed in a plastic binder.

If photoconductors showing no memory effect are used in the process according to the invention, the photoconductive material may be used in the form of a short endless belt. A long belt is preferred if the photoconductive layer is based on zinc oxide which shows memory effect. Such a long belt may be stored in a magazine, and sections of the belt may be subjected to the various processing stages after withdrawal from said magazine and may be stored again in a second magazine. The form of an endless belt, such as a zig-zag folded belt as described in United States Patent application Ser. No. 370,680 and the corresponding Dutch application No. 71 05 941, may also be employed.

The transferable image produced on the photoconductive materials sensitized with the nitro-substituted dyes defined hereinbefore may be a toner image or an electrostatic image. Consequently the electrophotographic processes according to the invention include processes in which a toner image is transferred to a receiving paper. Said toner image may be produced by charging, imagewise exposing and developing the photoconductive material with a toner which is common in electrophotography. The resulting toner image is transferred to a receiving paper in an usual way. The toner image may also be produced by imagewise exposing a photoconductive layer to form a conductivity image and developing the conductivity image by applying a toner in an electric field. The indirect electrophotographic process according to the invention may also be performed by developing an electrostatic image which has been transferred to a receiving paper, said electrostatic image being produced by charging and imagewise exposure.

Examples of the dyes suitable for use according to the invention are shown in Table I and Table II below.

Table I

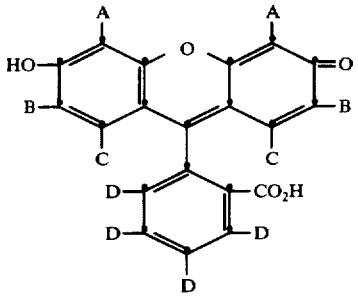

| | A | B | C | D |
|---|---|---|---|---|
| 1 | H | $NO_2$ | H | H |
| 2 | $NO_2$ | H | H | H |
| 3 | $NO_2$ | $NO_2$ | H | H |
| 4 | Br | $NO_2$ | H | H |
| 5 | $NO_2$ | Cl | H | H |
| 6 | I | $NO_2$ | H | H |
| 7 | $NO_2$ | H | H | Br |
| 8 | $NO_2$ | OH | H | H |
| 9 | $NO_2$ | Br | H | Cl |
| 10 | $NO_2$ | Br | H | Br |
| 11 | $NO_2$ | Br | H | H |

Table II

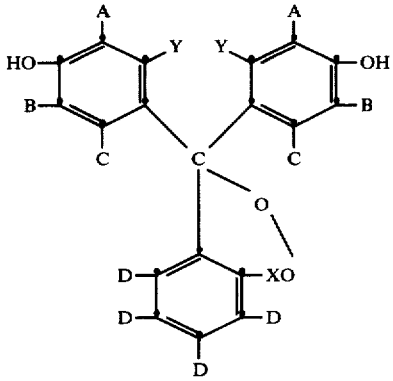

X = SO

| | A | B | C | Y | D |
|---|---|---|---|---|---|
| 12 | H | $NO_2$ | H | H | H |
| 13 | Br | $NO_2$ | H | H | H |
| 14 | Br | $NO_2$ | H | H | Br |
| 15 | Br | $NO_2$ | H | H | I |
| 16 | Cl | $NO_2$ | H | H | H |
| 17 | OH | $NO_2$ | H | H | H |
| 18 | OMe | $NO_2$ | H | H | H |
| 19 | Br | $NO_2$ | OH | H | H |
| 20 | Me | $NO_2$ | H | H | H |
| 21 | $NO_2$ | $NO_2$ | H | H | H |
| 22 | OH | $NO_2$ | H | $NO_2$ | H |
| 23 | H | $NO_2$ | H | H | Br |

Table II-continued

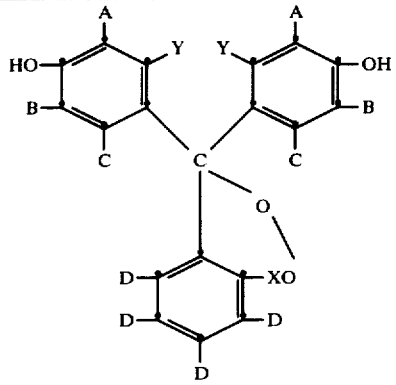

X = SO

| | A | B | C | Y | D |
|---|---|---|---|---|---|
| | X = a carbon atom | | | | |
| 24 | Br | $NO_2$ | H | H | H |

The practice of the invention is further illustrated by the following examples:

EXAMPLE I

A dispersion was prepared by mixing:

100 g of zinc oxide (Neige C of the firm Vieille Montagne), 17 g of a mixture of polyvinyl/acetate and a copolymer of ethylacrylate and styrene, 90 g of toluene, and 5 1 ml of a 4% by weight solution of dinitro-Bromphenol Red in methanol.

The dispersion was coated on a conductive paper and dried. The dried coating weighed 28 1 g per $m^2$. An endless belt of the resulting sheet material was used in an indirect electrophotographic book copier and subjected to repeated charging, exposure, development and transferring. The light-sensitivity of the photoconductive material decreased to a lower extent than the light-sensitivity of a similar photoconductive material in which the nitro-substituted dye was replaced by Bromphenol Red.

EXAMPLE II

A series of nitro-substituted dyes used in the process of the invention was compared with corresponding dyes containing no nitro groups by preparing a series of comparable photoconductive materials, each material being sensitized with one of the dyes mentioned in Table III below.

Each of the photoconductive materials was prepared by mixing:

100 g of zinc oxide (Neige C of the firm Societe de Mines et Founderies de la Vieille Montagne S.A.), 26.6. g of a mixture of polyvinyl/acetate and a copolymer of ethylacrylate and styrene (E 202 of the firm De Soto Chemical Company), 90 ml of toluene, and 1.2 ml of a 4% by weight solution of sensitizing dye in methanol or dioxane (depending on the solubility of the dyes).

The resulting dispersion was coated on a conductive paper and dried.

The light-sensitivity of each photoconductive material was measured before and after contacting the materials for three hours with air containing ozone in a concentration of 8 p.p.m. The results are collected in Table III which shows the light-sensitivities by the number of lux. sec needed to decrease the potential of the maximally charged photoconductive layer to 10% of the maximum value. The numbers of the compounds in Table III correspond with the numbers in tables I and II.

Table III

| | light-sensitivity | | change | reflection minimum | |
|---|---|---|---|---|---|
| | fresh | after ozone treatment | in % | wavelength in mm | reflection in % |
| Fluorescein | 30.5 | 42 | −40 | 497 | 62 |
| dinitrofluorescein (compound 2) | 61 | 56 | +10 | 496 | 51 |
| tetranitrofluorescein (compound 3) | 76 | 69 | +15 | 501 | 66 |
| 4,5-diiodo fluorescein | 14.5 | 20.5 | −40 | 524 | 52 |
| dinitro diiodo fluorescein (compound 6) | 46.5 | 43.0 | +5 | 512 | 51 |
| 4,5-dibromo fluorescein | 15 | 18.5 | −25 | 533 | 49 |
| saffrosine (compound 4) | 17 | 18.5 | −10 | 532 | 50 |
| 2', 7'-dibromo fluorescein | 22 | 31.5 | −45 | 503 | 59 |
| 2', 7'-dibromo dinitro fluorescein (compound 11) | 39.5 | 43 | −10 | 507 | 58 |
| hexabromo fluorescein | 28 | 39.5 | −40 | 532 | 67 |
| hexabromo dinitro fluorescein (compound 10) | 56 | 54 | +5 | 531 | 64 |
| dibromo tetrachloro fluorescein | 25 | 35 | −40 | 524 | 64 |
| dinitro dibromo tetrachloro fluorescein (compound 9) | 54 | 50 | +10 | 523 | 58 |
| Phenol Red | 50 | 66.5 | −35 | 450 | 64 |
| tetranitro Phenol Red (compound 21) | 40.5 | 37 | +10 | 575 | 63 |
| Bromphenol Red | 14.5 | 26 | −80 | 589 | 71 |
| dinitro Bromphenol Red (compound 13) | 12 | 12 | 0 | 600 | 59 |
| Chlorphenol Red | 14 | 23 | −65 | 586 | 67 |
| dinitro Chlorphenol Red (compound 16) | 10 | 11 | +10 | 602 | 55 |
| dibromo dinitro tetraiodo phenol sulphonphthalein (compound 15) | 15.5 | 17 | +10 | 625 | 71 |
| hexa bromo dinitro phenol sulphonphthalein (compound 14) | 19 | 20 | +5 | 622 | 72 |

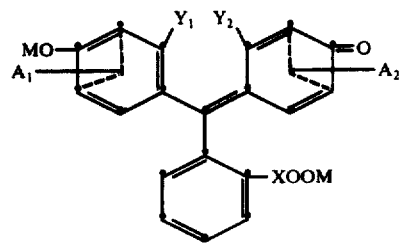

We claim:

1. In a process of indirect electrophotographic copying wherein a sheet material comprising a dye-sensitized photoconductive layer is repeatedly exposed imagewise to form on said layer by each exposure an image which as such or upon being developed is transferred from said material, the improvement wherein said material comprises a photoconductive layer sensitized by at least one dye selected from the group consisting of dyes represented by the following formula and mesomeric and tautomeric forms thereof:

in which M represents a hydrogen or metal atom or a methyl or ethylgroup, $A_1$ or $A_2$ or both $A_1$ and $A_2$ represent a nitro group in an ortho position with respect to the —OM and/or keto group, X represents a carbon atom or a SO group and $Y_1$ and $Y_2$ represent a substituent selected from the group consisting of hydrogen and halogen atoms and lower alkyl, lower alkoxy, nitro, hydroxyl and esterified hydroxyl groups and the remaining positions may be unsubstituted or substituted by one or more substituents selected from the group consisting of halogen atoms and lower alkyl, lower alkoxy, nitro, hydroxyl and esterified hydroxyl groups.

2. A process according to claim 1, said layer containing a photoconductor and containing said at least one dye in an amount of between 0.001 and 1% of the weight of said photoconductor.

3. A process according to claim 1, said layer comprising a photoconductive zinc oxide dispersed in an organic binder and containing said at least one dye in an amount of between about 0.02 and 0.25% of the weight of said zinc oxide.

4. A process according to claim 1, said at least one dye comprising a nitro-substituted phenolsulfonephthalein.

5. A process according to claim 1, said at least one dye comprising dinitro-Bromphenol Red.

6. A process according to claim 1, said at least one dye comprising dinitro-Chlorphenol Red.

7. A process according to claim 1, said layer comprising a photoconductive zinc oxide dispersed in an organic binder and being sensitized by a mixture of dyes comprising a nitro-substituted Bromphenol Red and methylene blue, erythrosine or Bromphenol Blue.

8. In a process of indirect electrophotographic copying wherein a sheet material comprising a dye-sensitized photoconductive layer is repeatedly exposed imagewise to form on said layer by each exposure an image which as such or upon being developed is transferred from said material, the improvement wherein said material comprises a photoconductive layer sensitized by at least one dye selected from the group consisting of tetranitro Phenol Red, dinitro Bromphenol Red, dinitro Chlorphenol Red, dibromo tetraiodo phenol sulfonephthalein, hexa bromo dinitro phenol sulfonephthalein.

* * * * *